US011613329B2

(12) United States Patent
Lacefield

(10) Patent No.: US 11,613,329 B2
(45) Date of Patent: Mar. 28, 2023

(54) ADJUSTABLE MULTIHULL RUNNING SURFACE DEVICE FOR WATERCRAFT AND RELATED METHODS

(71) Applicant: Dustin Lacefield, Fresno, CA (US)

(72) Inventor: Dustin Lacefield, Fresno, CA (US)

( * ) Notice: Subject to any disclaimer, the term of this patent is extended or adjusted under 35 U.S.C. 154(b) by 53 days.

(21) Appl. No.: 17/083,283

(22) Filed: Oct. 28, 2020

(65) Prior Publication Data

US 2021/0229783 A1 Jul. 29, 2021

Related U.S. Application Data

(60) Provisional application No. 62/965,888, filed on Jan. 25, 2020.

(51) Int. Cl.

| | |
|---|---|
| ***B63B 1/22*** | (2006.01) |
| ***B63B 83/00*** | (2020.01) |
| ***B63B 1/30*** | (2006.01) |
| ***B63B 39/06*** | (2006.01) |
| ***B63B 35/38*** | (2006.01) |
| ***B63B 1/12*** | (2006.01) |
| ***B63B 1/14*** | (2006.01) |
| ***B63B 1/18*** | (2006.01) |

(52) U.S. Cl.

CPC ..... *B63B 1/22* (2013.01); *B63B 1/125* (2013.01); *B63B 1/30* (2013.01); *B63B 35/38* (2013.01); *B63B 39/06* (2013.01); *B63B 83/00* (2020.01); *B63B 2001/145* (2013.01); *B63B 2001/183* (2013.01)

(58) Field of Classification Search

CPC ..... B63B 1/12; B63B 1/121; B63B 1/125; B63B 2001/145; B63B 2001/183; B63B 1/22; B63B 1/30; B63B 35/38; B63B 39/06; B63B 83/00; B63B 83/20

See application file for complete search history.

(56) References Cited

U.S. PATENT DOCUMENTS

| | | | | |
|---|---|---|---|---|
| 3,270,701 | A * | 9/1966 | Kubas | B63B 39/005 114/121 |
| 6,016,762 | A * | 1/2000 | Price | B63B 1/18 114/274 |
| 6,223,674 | B1 * | 5/2001 | Wyman | B63B 39/005 114/271 |
| 6,619,224 | B1 * | 9/2003 | Syfritt | B63J 3/04 114/355 |
| 9,233,732 | B2 * | 1/2016 | Wilson | B63B 35/34 |
| 9,315,236 | B2 | 4/2016 | Gasper | |

(Continued)

FOREIGN PATENT DOCUMENTS

WO WO-2009028935 A2 * 3/2009 ..... B63B 1/12

*Primary Examiner* — Ajay Vasudeva

(74) *Attorney, Agent, or Firm* — Sierra IP Law, PC; William K. Nelson

(57) ABSTRACT

The present invention provides a hull-conversion device and method for modifying the underside of a watercraft, more specifically a multihull watercraft. The hull-conversion device comprising a water diverting surface, a kinematic assemblage, and a frame. The hull-conversion device may be operable to adjust the watercraft's characteristics in displacement mode and planing mode. The hull-conversion device may function to provide a more stable, controllable, and efficient platform for operating a multihull watercraft, and provide a suitable wake for towable water sports.

18 Claims, 9 Drawing Sheets

(56) References Cited

U.S. PATENT DOCUMENTS

| | | | | |
|---|---|---|---|---|
| 9,573,655 | B1 | 2/2017 | Pigeon | |
| 9,676,449 | B1 * | 6/2017 | Syryda | B63B 1/14 |
| 9,855,995 | B2 | 1/2018 | Fafard et al. | |
| 9,862,457 | B2 | 1/2018 | Pigeon | |
| 10,179,628 | B2 | 1/2019 | Gasper et al. | |
| 10,202,171 | B1 | 2/2019 | Miller et al. | |
| 10,308,321 | B1 | 6/2019 | Miller et al. | |
| 10,322,777 | B2 | 6/2019 | Gasper et al. | |
| 10,479,461 | B1 | 11/2019 | Hartman et al. | |
| 10,501,148 | B2 | 12/2019 | Huyge et al. | |
| 10,501,156 | B1 | 12/2019 | Sheedy et al. | |
| 10,589,823 | B1 | 3/2020 | Fenech et al. | |
| 10,745,084 | B2 | 8/2020 | Forrest et al. | |
| 11,155,321 | B2 * | 10/2021 | Minor | B63B 35/613 |

* cited by examiner

ADJUSTABLE MULTIHULL RUNNING SURFACE DEVICE FOR WATERCRAFT AND RELATED METHODS

The present application claims priority to U.S. Provisional Patent Application No. 62/965,888, filed on Jan. 25, 2020, which is incorporated by reference herein in its entirety.

FIELD OF THE INVENTION

The present invention generally relates to an adjustable multihull running surface apparatus for watercraft, and methods of using the same. More particularly, the present invention incorporates deployable hull surfaces in pontoon watercraft for wake generation and watersports.

BACKGROUND OF THE INVENTION

The shape of a watercraft's hull determines how it travels through the water and the applications for which it is suited. The hull shape is generally selected to satisfy various attributes, such as loading capability, carrying capacity, stability, speed, and hydrodynamic parameters for the watercraft's intended function; a hull's geometry generally sacrifices one attribute for increased performance in another attribute. A pontoon boat is a watercraft that is generally fuel-efficient, highly stable, and smooth cruising at slow speeds in smooth waters; the watercraft typically uses two or three pontoons for buoyancy and lies flat on the water. Alternatively, a V-shaped hull boat is more fuel-efficient when cruising at high speeds since slower speeds impinge on the hull's natural ability to rise and slice through the water. The V-shaped hull enables the boat to cut through the water and get up on plane at high speed, creating a surfable wake. However, since a V-shaped hull boat pivots on a central axis, this can cause the craft to roughly rock due to the movement of passengers in turbulent wind and waves. A watercraft travels through the water and has one of two general modes of operation: pre-planing mode, including displacement mode and semi-planing or transition mode, and planing mode.

In displacement mode, the watercraft is moving relatively slowly through the water, the primary force that keeps the boat from sinking is buoyancy. The watercraft in displacement mode has a forward bow lifting out of the water, and a stern movement, about midship, downward into the water. In semi-planing mode, the hull is traveling at sufficient speed to generate a moderate amount of hydrodynamic lift, but the primary force that supports the boat's weight is still buoyancy. In planing mode, the hull generates even more lift so that the primary forces supporting the boat's weight are hydrodynamic rather than buoyant. These hydrodynamic forces tend to lift the running surface out of the water, thereby reducing drag to overcome the instability of a lifted running surface.

A hull's shape generally has a geometric design to perform well in one of the three modes of operation. A V-shape hull is ideal for wake generation and towing skiers in the two semi-planing and planing modes, while pontoons perform well in displacement and semi-planing modes, the pontoon boat struggles to develop a sustainable wake. Pontoon watercraft may have various mechanisms that assist in wake generation at high speeds; however, the system remains inefficient at such speeds. It is ideal for a pontoon watercraft to have the ability to have a device that provides a variable running surface that performs well in both of the planning modes.

SUMMARY OF THE INVENTION

The present invention provides an improved multihull watercraft, deployable and variable running surface, and watersports boat incorporating such a system, and methods of using such a system. The deployable hull conversion system is operable, e.g., to allow a boat to convert from a multi-hull vessel (e.g., a pontoon boat with two or more pontoons) to a laterally continuous, single hull (e.g., a round or v-shaped hull like that of a ski boat). The deployable hull conversion system may be operable to allow the vessel to be used as both a multi-hull vessel for more level, stable use of the vessel, and to convert to a single hull vessel for higher speed and planing use for water sports, such as skiing.

The multihull watercraft of the present invention may provide a stable platform for planing and displacement of the water as the watercraft travels through the water. The running surface of the water is the total distance a boat penetrates the water, from waterline to keel or appendage bottom, this surface may include the pontoons (e.g., hollow metal tubes) which are operable to reserve buoyancy in multihulled watercraft, and may be a watercraft with three pontoons called "tri-toons." The deployable running surface of the present invention may have a surface that is acting as the keel of the boat and has a deployment mechanism operable to deploy the running surface symmetrically outward to resemble a V hull surface for planing the water by nesting endpoints of the wings on each pontoon. The variable running surface may be operable to shift the hull geometry of the V hull surface for the watercraft to have different hull characteristics in the various modes of operation. The V-hull configuration of the present invention may be operable to generate a wake or numerous asymmetric wakes when the system is planing the water and may be operable to pull water-skiers to enable surfing of the generated wake.

The deployable and variable running surface of the present invention may be incorporated into a multihulled vessel, deck, and pontoon typed watercraft. The variable running surface may include diverting plates in a string of plates which may be affixed to the running surface of the centerline of a vessel with two or more pontoons and may include a deployable conversion system to contact the outer pontoons sealing the system. The deployable mechanism may include a gear train, actuators, and various kinematic chains to facilitate achieving the required motion of the water diverters. A kinematic chain may consist of an assemblage of links and joints, interconnected to provide control of an output motion in response to a supplied input mechanism. The input mechanism may be an electromechanical and/or hydraulic actuation system. In some embodiments, there may be multiple input mechanisms, providing a variable geometry to the diverting plates. The input mechanism may also be operable to hold the variable geometry in a fixed orientation.

The water diverters of the present invention may be a string of plates that are configured to deploy outwardly from the centerline and may nest into the pontoons. The diverting plates may contain various slots or holes for redirecting the flow of water from the head to the stern of the vessel, assisting in wake generation while planing the surface. The water diverting plates of the present invention may be concealed on the underside of the watercraft when operating in the displacement mode or cruising in calm waters to remain efficient and maintain the various benefits of the pontoons running surface. The water diverting plates of the present invention may be deployed to convert the vessel to the V hull configuration to modify the running surface of the watercraft such that it can generate a wake. The kinematic mechanisms may be operable to limit the motion of adjacent diverting plates. The string of plates may comprise at least two plates, but in some embodiments, it may be an advantage to incorporate two or more plates to allow the system flexibility in the depth and wake generated from deployment.

The diverting plates may initially nest in a low-profile stack that hugs near the centerline of the vessel. When actuated, a kinematic mechanism comprising a series of linkages that may be operable to deploy the diverting plate system along a predetermined path to the deployed configuration. The linkages may comprise a combination of fourbar mechanisms, parallelogram mechanisms, and/or various pivoting nodes. The various linkage configurations may connect to various full joints, heim joints, and/or first and second-order pin joints. The kinematic mechanisms may be attached to the diverting plates with pinned flanges that may be fixed to the diverting plates and may be operable to limit the motion of the diverting plates through a deployment path. The diverting plates may have a system of actuators that actuate the diverting plates through a motion allowed by the kinematic mechanisms. In some embodiments, the linkage configurations may be operable to actuate the system to the deployed configuration.

The diverting plate system may deploy to the variable running surface configuration with actuators that may be fixed on one end to the initial running surface and locations on the diverting plates. The actuators may be operable to move the plates simultaneously without interference through a predetermined path and may have multiple actuators to provide rigidity and strength to the diverting plate configuration. The actuators may be operable to adjust the angle of the running surface and displace the surface of the water to generate a surfable wake. The diverting plate system may deploy when the watercraft is in the water, and before the watercraft enters the water. In some embodiments, the actuators may be of the electrical type (e.g., linear and rotary) or hydraulic rotary type configured to move the diverting plate system to the deployed position. The actuators may receive commands from a central controller that contains electronic circuitry (e.g., a computer processing unit, a memory, storage, control logic, etc.). For example, in embodiments that utilize hydraulic actuators, the central controller may be operable to control a hydraulic hub that may be in communication with a hydraulic pump. The hydraulic pump may provide a fluid dynamic advantage for linear actuation and may provide a sufficient force for withstanding a resultant force of water acting on the variable running surface. In addition, some diverting plates may have a hydraulic actuator connected to another diverting plate.

In embodiments that utilize hydraulic actuators, the hydraulic actuators may include a base, port, piston, linear rod, and clevis (e.g., rod mount) attached to a slot mechanism (e.g., carriage and guide rail, rail and slide, etc.). Slot may further refer to a dynamic attachment to facilitate slip and rotation of a coupled joint of a linkage and/or actuator, and the slot path may be curved or linear. The actuator base may be pinned to a fixed surface flange with a shaft; the surface flange may utilize a permanent fastening method (e.g., welding, brazing, etc.) to fix to the surface; the actuator may be able to rotate about the shaft. The hydraulic actuator port may be capable of transferring pressure from a hydraulic hub to a tube, which applies pressure to the piston, extending the linear rod. At the distal end of the linear rod may be a clevis that may be operable to connect to a pinned hub (e.g., carriage, slide, etc.). The clevis may attach to the hub with a rotatable pin, and the hub may attach to a slot on a surface. The hub and slot may have complementary shapes. The hub may freely slide within the boundaries of a guide rail's endpoints. When actuated, the linear rod extends, applying a force to a diverting plate and sliding against the guide rail for modifying the angle of the actuator from the actuator base attachment location.

In some implementations, the hydraulic actuator may be of the hydraulic piston rod locking type, and may have a locking section with two additional hydraulic ports, one for retracting and the other for unlocking the system. The locking section may include a rod and liner enclosed in a sleeve that forms an interference fit with the outside diameter of the rod. This interference may provide a positive mechanical connection to lock the rod in any phase of the stroke. As soon as hydraulic pressure is applied, the sleeve may expand radially, which may (1) remove the interference and create enough clearance for the rod to be stroked with minimal resistance, and (2) relieve hydraulic pressure to automatically re-engage the rod lock. The advantage of the rod locking type for linear actuation may ensure a resultant load is not transferred to the hydraulic source and may further supplement structural integrity that may have characteristics of a strut when in the locked configuration.

In some embodiments, the diverting plate system may include a frontal shroud that deploys to seal the pontoons with a variable running surface when in the deployed configuration which may prevent excess fluid from entering a control volume (e.g., the space between the underside of the deck of the watercraft, water diverting surface, and portside and starboard side floats). The frontal shroud may be attached to the deck surface with a hinge and may be rotatably mechanized to actuate perpendicularly to the deck. The frontal shroud may further assist in diverting the fluid to the variable surface. The frontal shroud may have a surface geometry that may be generally planar and intended to streamline the fluid along the running surface. In some embodiments, the frontal shroud may be actuated toward the forward bow at an angle, to allow space for the deployment of the variable running surface and may then be returned to seal the leading edge of the water diverting surface. The surface geometry may have a generally convex frontal surface geometry, and may further assist in streamlining the fluid under the variable running surface for adequate lift generation.

Regarding the deployment of the diverting plate system, as an example, without limitation, the diverting plate system may have three plates on either side of the centerline of the watercraft, one port side array, and one starboard side array. Each plate may have two faces, a deck face, and a surface face, and may have four edges (starboard, port, forward, and stern). A deck face is the face of the diverting plate that faces the deck of the watercraft. On the port side of the watercraft, the most centerline diverting plate may be hinged on the starboard side of the midline (e.g., a keel) of the vessel and hinged to a mid-diverting plate on the portside. The mid-diverting plate may have a joint connector (e.g., a T-joint-pin) on the portside edge of the mid-diverting plate and may be operable to nest into a slot of a final port diverting plate. The final port diverting plate may have a rotating pivot (e.g., inline perpendicular pivot hinge) for nesting the joint connector (e.g., T-joint-pin) of the mid-diverting plate. The rotating pivot may coalesce into a slot on the surface face from the plate's starboard edge to an intermediary location between the port and starboard edge. The deck face of the final portside diverting plate may have a slot that traverses the distance between the plate's starboard and port edges.

Attached to the slot may be a hub that may be operable to linearly slide along the path of the slot. A hydraulic actuator on one end may be attached to the hub and pivotally affixed to the deck on the other. Additional actuators may be attached to the mid-diverting plate and the most centerline diverting plate, the mid-diverting plate may require a slot and hub system to accommodate linear actuation and rotation about the hinge. The diverting plate system on the starboard side may be symmetric to the port side.

Further, when actuated by an operator, a hydraulic actuator attached to the deck face may linearly extend while simultaneous pushing the hub of the port diverting plate against the distal end (e.g., port side edge) of the deck face slot and invoking the joint connector (e.g., T-joint-pin) of the mid-diverting plate to slide into the rotating pivot of the most portside water diverting plate. The mid-plate may then use a second actuator to rotate the centerline plate about the pivot. The water diverting plate may have stop tabs that prevent the plate from extending beyond the desired limit, and the plate may continue to rotate the plates to the deployed position.

In some embodiments, the variable running surface may have additional linkage systems attached to the keel with various members to reinforce the structure along the centerline. The additional linkage systems may comprise a kinematic assemblage of parallelogram form linkages with hinged intersections that allow the operator to elongate the mechanism while maintaining the integrity of the geometric relationship between subsequent linkages. The system may have on the distal ends a pin nested in a slot mechanism with two degrees of freedom allowing for translation and rotation about the slot mechanism. The system may have a slot permanently fastened to the centerline of the variable running surface, and the watercraft may have an additional slot to temporarily fastened to the keel of the watercraft. The additional linkage system may nest intermediately between the two slots. On one end of the linkage system, the pin systems may fix the sternmost linkage end (e.g., rearmost linkage point) with a shaft. The linkage system may actuate together using a hydraulic actuator of the linear or rotary type. In some implementations of the additional linkage system, the kinematic assemblage may actuate with an electronic actuator of the linear type, rotary type, and combinations of both.

In another embodiment, the variable running surface may be a configuration comprising a plurality of water diverting plates in a fixed configuration. The variable running surface may include a plurality of individual water diverting plates movable along a telescopic rail system. The variable running surface on the deck side face may be operable to secure a telescopic rail system with a bracket and a clevis pin system. The telescopic rail system may comprise at least two pieces that can be nested and locked together with a pin or bolt alike. The initial running surface may have a flange (e.g., mounting foot) operable to receive one end of the telescoping rail set, and the variable running surface may be connected to the initial running surface and slid into the final position. The two telescoping rails may be fixed together with a bolt between pinholes. The variable running surface may ideally be attached and detached to the initial running surface when the watercraft is out of the water.

Because the variable running surface and frontal water diverting plate may be used in a marine environment, it may be preferable to construct the components of the system from materials suitable for marine use. The materials are primarily corrosion-resistant metal alloys (e.g., stainless steel, aluminum, etc.) and conventional maritime industrial materials. The variable running surface may include materials such as fiberglass, corrosion-resistant metals, plastics, wood, and combinations thereof. The linkage systems may have a metallic construction and utilize various plastic members for housing; there may be intermediary rubber grommets between adjacent surfaces at the various mounting locations for reduced vibrations. The rotating and sliding components may have bearings between adjacent components to assist in a free-form slip, and the hinged locations may incorporate ceramic and plastic materials. An electrical actuator may have a watertight structure for sealing sensitive components. The hydraulic actuators may have various seals and grommets for preventing contamination of the working fluid within the hydraulic housing. The telescoping rail set may be constructed of lightweight and durable material and must function to withstand extreme loading conditions. The flange or mount footing of the initial running surface may be comprised of one or more suitable materials and may contain a bearing at the pinned locations to allow for rotation.

In some embodiments, a spring and dampener system may attach to a diverting plate and the initial surface to provide rigidity and strength of the variable running surface. The spring and dampener system may be manually placed in the system at a predetermined location on the initial surface and the running surface and may, in some implementations, actuate to nest between the running surface and initial surface.

In another embodiment, the variable running surface may have a lifting mechanism mounted to the centerline of the watercraft, the lifting mechanism may be comprised of a series of parallel form linkages (e.g., scissor linkage) and may nest between the keel of a central pontoon and the centerline of the variable running surface. A linkage may be a linear rod having three pivoting locations for joining, a first end and second end having hole operable to receive a joint, and a third hole equidistance from the first end and second end for receiving a shaft. The keel of the central pontoon may have a plurality of keel slots (e.g., T slot, planar slot) that receive the linkage end joints (e.g., pin, pinhole) to nest within the slots; the variable running surface alike may have a plurality of slots, that mirror the keel slots, and enable the linkage end joints to nest within the slots. The slots allow for translational and rotational motion (e.g., 2-DOF) of the linkage arm about the central axis of the joint endpoints. Off the keel of the center, pontoon may be a flange (e.g., clevis, pin joint, etc.) fixedly attached forward of the plurality of keel slots, similarly off the deck side of the variable running surface may be a flange fixedly attached forward of the plurality of surface slots; the flanges may be treated as a ground joint (e.g., welded, brazed, etc.).

The linkage mechanism having the first parallel form linkages, forming a primary set, and may have a mirrored set of linkages complementary, and that may be inverse and opposite to the primary set. Each of the linkages in the primary set may be symmetrically mounted to the corresponding linkage in the mirror set and may form a member pair; the member pairs are mounted together with a shaft at their respective equidistance third hole. The forward-most linkage end holes (e.g., first end) of the member pairs may be attached to their respective keel or surface flange with a shaft that may be operable to rotate about the central axis of the shaft; the flange may be operable to ground the linkage system fixedly. The linkage attached to the keel flange may have the second end hole attached to the surface slot, and the linkage attached to the surface flange attached to the keel slot. The second member pairs may have one end link attached to the keel slot, and the mirrored link attached the surface slot. The remaining end link of the second member pairs may mount to the slot opposite of the first endpoint location. The linkage mechanism may have a plurality of additional member pairs mounted in the same fashion as the second member pairs. The final member pair on the sternmost side may attach the linkage ends to an actuator (e.g., hydraulic, electrical, linear, rotational) for linearly expanding and contracting the linkage mechanism. The linkage mechanism may be operable to assist lifting the variable running surface off of the keel and may have additional systems for locking (e.g., hydraulic lock, locking solenoid, cam latches, etc.) the array of linkages in place.

In some implementation of the linkage mechanism, it may be advantageous for the linkage system to include member pairs of varying lengths to preceding member pairs and modifying the structure of the linkage system for enablement of angular control of the running surface with respect to the deck of the system. The variable running surface may pivot about the frontal water diverting plates seal; this allows the system to increase the depth of the running surface and may assist in generating a larger wake when planing, the angle of the system may be variable and have various stages. For example, without limitation, a first stage may have a 0° angle and be configured parallel to the deck of the watercraft, a second stage may have a 2.5° angle with respect to the deck of the watercraft, a third stage may have a 4° angle with respect to the deck of the watercraft, and a fourth and fifth stage may follow suit. Modifying the angle of the variable running surface may cause the angles of the adjacent plates to change in relation to the initial deployed configuration, and the curvature of plates may be fine-tuned through length adjustments from the actuators. The angle of the stages may vary according to the operational conditions and predetermined configurations in the system. As the angle of the surface changes, water may enter the control volume; thus, a float tab may have a variable seal that may assist in filling space between the variable surface edges and the floats. The variable seal may adjust in accordance with the various stages of the running surface. In some embodiments, the unwanted water may be pumped out of the control volume, using at least one pump.

In some embodiments, the watercraft may have the trim tabs mounted aft of the transom on the port side, and starboard side floats for diverting water traveling past the transom of the watercraft and generating a surfable wake. Each of the trim tabs may be movable between a deployed and non-deployed position. A hinge for pivotally mounting the trim tab relative to the transom, the hinge may have a pivoting axis that may be substantially adjacent to the transom edge and a drive mechanism that may be operable to adjust the angle of the trim tab relative to the float. The trim tabs may have various stages of actuation that enable the tabs to divert a substantial amount of water for wake generation, increase the force at the stern, and lower the watercrafts forward bow to a suitable planer running angle for the watercraft; thus, increasing the overall efficiency and attitude of the watercraft at high speeds. For example, without limitation, a first stage may have a 0° angle and may be configured parallel to the deck of the watercraft, a second stage may have a 5° angle with respect to the pivoting axis, and a third stage may have a 6.5° angle.

Because the trimming tabs are suited for use in a marine environment, it may be preferable to construct the components from materials suitable for marine use. The materials are primarily corrosion-resistant metal alloys (e.g., stainless steel, aluminum, etc.), and conventional maritime industrial materials.

In some embodiments, the watercraft may include a graphical user interface and controller for a drive mechanism, a speed sensing device, pressure sensors, and a plurality of linear actuators. Each drive mechanism may operate to move a corresponding trim tab device between the deployed position, and the non-deployed position, the speed sensing device may operate to determine the speed of the watercraft. The controller may be operable to actuate the drive mechanisms to move the trim devices to the deployed position while receiving data regarding the speed of the watercraft from the speed sensing device. The controller may be capable of determining when the speed of the boat exceeds a first predetermined threshold and actuate the drive mechanism corresponding to the first trim tab device to move the first trim device from the deployed position to the non-deployed position when the speed of the boat exceeds the first predetermined threshold. The controller may further operable to determine when the speed of the boat exceeds a second predetermined threshold and actuate the drive mechanism corresponding to the second trim-tab device to move the second trim-tab device from the deployed position to the non-deployed position when the speed of the boat exceeds the second predetermined threshold. In addition, the controller may be capable to determine when the speed of the boat exceeds a third predetermined threshold and actuate the drive mechanism corresponding to the third trim-tab device to move the third trim-tab device from the deployed position to the non-deployed position when the speed of the boat exceeds the third predetermined threshold. At least one of the first, second, and third predetermined thresholds may be different from the other two of the first, second, and third predetermined thresholds.

Further, the controller may be operable to determine when the speed of the boat exceeds a first predetermined threshold and actuate the linear actuators corresponding to the variable running surface. The actuation of the diverting plate system from the stowed position to the deployed position may begin when a speed sensor determines if the watercraft falls within the speed threshold for the deployment of the variable running surface. The controller may also function to determine if the speed of the watercraft has exceeded the maximum speed for the variable running surface. The controller may have a series of pressure sensors placed on the variable running surface for determining the load (e.g., resultant force) of the system and the integrity of the running surface.

In one aspect, the present invention relates to a variable hull-conversion device for a multihull watercraft, the device comprising: an adjustable water diverting surface having a port side surface and a starboard side surface pivotally secured to a central structure of the multihull watercraft and operable to modify the underside of the multihull watercraft, each a port side and a starboard side surface being movable between a deployed position and a non-deployed position, and a deployment mechanism for deploying the water diverting surfaces to transform the hull geometry of multihull water craft to a dynamic V-hull configuration. The variable hull-conversion device may include a port side surface and starboard side adjustable water diverting surface each comprising a plurality of water diverting plates, each water diverting plate having a deck face, a water face, a front edge, a port edge, a starboard edge, and a trailing edge. Each of the water diverting plates may be pivotally and/or slidably attached to adjacent plates on the plates port edge, starboard edge. The deployed position configures the water diverting surface to nest a port side edge of the port side surface to a lateral position on a port side float of the multihull watercraft, and to nest the starboard edge of the starboard side surface to a lateral position on a starboard side float of the multihull watercraft. The non-deployed position configures the water diverting surface to stow at or near the central structure of the multihull watercraft. The deployment mechanism to include a kinematic chain assemblage, with at least one primary linear actuator having one proximal end pivotally attached to the underside of the multihull watercraft, and one distal end slidably and pivotally attached to a dynamic attachment affixed to the water diverting surface, and at least one secondary linear actuator between adjacent plates of the water diverting surface, having one proximal end pivotally attached to the deck face of a first plate, and one distal end slidably and pivotally attached to a second plate. The assemblage includes a series of linkages and mechanisms, operable to cooperate with the linear actuators to expand the water diverting plates on a predetermined path from the non-deployed position to the deployed position. The kinematic chain assemblage may be attached between adjacent plates of the water diverting surface, and may be intermediately attached between water diverting surface and the underside of the keel of the watercraft. The deployment mechanism may further have the ability to modify the angle of the water diverting surface with respect to the deck of the watercraft. A dynamic V hull configuration that may be capable of adjusting the water diverting surface curvature when in motion, lift the forward bow to squat the multihulled watercraft when in a planing mode, and generate a surfable wake. A surface curvature may include the various angles of the water diverting plates with respect to their mounting location and relative to the underside of the multihull watercraft. The variable hull-conversion device includes a frontal water diverting plate for redirecting water and sealing a front edge of the water diverting surface. A frontal water diverting plate with a curved geometry that may be rotatably mechanized on a proximal end to the underside of the multihull watercraft, and operable to seal the front edge of the water diverting surface on a distal edge. The frontal water diverting plate may have an initial position for allowing the water diverting surface clearance when being deployed to the final position for sealing the front edge of the water diverting surface. The variable hull-conversion device may include a graphical user interface and controller for controlling the deployment of the adjustable water diverting surfaces transformation from the deployed and the non-deployed position. The graphical user interface may be further operable for adjusting the pitch of the watercraft with respect to the waterline and the deployment mechanism. The variable hull-conversion device that may be operable to deploy when the watercraft is statically positioned, in the water moving, and out of the water.

In a second aspect, the present invention relates to a hull-conversion device for a multihull watercraft, the device comprising: a water diverting surface in a V hull configuration for modifying the underside of the multihull watercraft; and a frame for securing and positioning the water diverting surface to a deck of the multihull watercraft. The hull-conversion device may include a diverting surface which may be a continuous surface in a V-hull shape, having a port edge, and a starboard edge for sealing with a port side float and a starboard side float of the multihull watercraft. The hull-conversion device may include a frame which may comprise a plurality of members including an inner rail, an outer rail, and a crossmember; the outer rail section embracing the inner rail section for slidably engaging with the inner rail for telescopically adjusting the distance of the water diverting surface with the deck. The plurality of members may be configured to be secured to adjacent members with a fixed fastener and/or temporary fastener. The hull-conversion device may include a frontal water diverting plate for redirecting water and sealing a front edge of the water diverting surface. The hull-conversion device may have a V-hull configuration that may be operable to modify the under-surface curvature of the multihull watercraft, lift the forward bow to squat the multihulled watercraft when in displacement and planing mode, and generate a surfable wake.

In a third aspect, the present invention relates to a multihull watercraft having a plurality of trimming devices positioned aft of the transom, and sternly attached about the portside float and the starboard side float. The trimming device may be configured in a fixed orientation to generate a resultant force from the water to the stern of the multihulled watercraft as the boat moves through the water. The trimming device may be pivotally fastened and configured to swivel between a deployed and non-deployed position by utilizing a drive mechanism corresponding to the trimming devices. The trimming device may be pivotally fastened and configured to swivel between a deployed and non-deployed position with a drive corresponding to the relative trimming devices. The trimming device may function to redistribute the force of the water acting on the adjustable water diverting surface on the multihull watercraft and may overcome the squat angle of the multihull watercraft when the watercraft is operating in the displacement mode or the planing mode.

In a fourth aspect, the present invention relates to a hull conversion assembly for a multihull watercraft, the device comprising a deployable hull conversion assembly comprising water diverting surfaces movably secured to a central structure of the multihull watercraft and operable to modify an underside of the multihull watercraft when deployed, the deployable water diverting surface being movable between a stowed position and a deployed position; and a deployment mechanism for deploying the water diverting surface to the deployed position to transform the hull geometry of the multihull water craft to a single hull configuration. The deployable hull conversion assembly may include a port side adjustable water diverting surface and a starboard side adjustable water diverting surface each having a plurality of water diverting plates, each of the water diverting plates having a deck face, a water face, a front edge, a port edge, a starboard edge, and a trailing edge. Each of the plurality of water diverting plates may be pivotally and/or slidably attached to adjacent plates on the plates port edge, starboard edge. The deployed position of the hull conversion assembly may have a port side outer portion that contacts a port side float of the watercraft, and a starboard outer portion may contact a starboard side float of the watercraft. In the stowed position the water diverting surfaces may be stowed at or near the central structure of the multihull watercraft. The deployment mechanism may include a kinematic chain assemblage, at least one primary linear actuator having one proximal end pivotally attached to the underside of the multihull watercraft, and one distal end slidably and pivotally attached to a dynamic attachment affixed to the water diverting surface, and at least one secondary linear actuator between adjacent plates of the hull conversion assembly, having one proximal end pivotally attached to a deck face of a first plate, and one distal end slidably and pivotally attached to a second plate. The kinematic chain assemblage may include a series of linkages and mechanisms operable to cooperate with the linear actuators to expand the water diverting plates on a predetermined path from the stowed position to the deployed position. The kinematic chain assemblage may be attached between adjacent plates of the hull conversion assembly, and intermediately attached between the water diverting surface and the underside of a midline of the watercraft. The deployment mechanism may further have the ability to modify the angle of the water diverting surface with respect to a deck of the watercraft. The single hull configuration may be operable lift the forward bow to squat the multihulled watercraft when in a planing mode, and generate a surfable wake. The hull conversion assembly may include a frontal water diverting plate for redirecting water and sealing a front edge of the water diverting surface. The frontal water diverting plate may have a curved geometry, and may be rotatably connected to the underside of the multihull watercraft, and may be operable to seal the front edge of the water diverting surface at its front edge. The frontal water diverting plate may have an initial position for allowing a clearance of the water diverting surface deployment and final position for the sealing the front edge of the water diverting surface. The hull conversion assembly may be controlled by an electronic controller operable to activate the at least one primary linear actuator and the at least one secondary linear actuator to deploy the hull conversion assembly. The controller may be operable to activate a deployment mechanism to change the water diverting surface from the stowed position to the deployed position to adjust a pitch of the watercraft with respect to the waterline during motion. The hull conversion assembly may be operable to be deployed when the watercraft is statically positioned, in the water moving, and out of the water. The multihull watercraft may have at least one trimming device positioned aft of the transom, and sternly attached about the portside float and the starboard side float. The at least one trimming device may be configured in a fixed orientation to create an upward force on the stern of the boat as the boat moves through the water. The at least one trimming device may be pivotally fastened and configured to swivel between a deployed and non-deployed position with a drive corresponding to the trimming devices. The at least one trimming device may function to redistribute the force of the water on multihull watercraft and overcome the squat angle of the multihull watercraft when in displacement and planning mode. The multihull watercraft may be operable to pull skiers when the hull conversion assembly is in the deployed position.

In a fifth aspect, the present invention relates to a method of converting a multihull watercraft to a single-hull watercraft, comprising deploying a hull conversion assembly having water diverting surfaces movably secured to a central structure of the multihull watercraft to modify an underside of the multihull watercraft, transforming the hull geometry of the multihull water craft to a single hull configuration, the water diverting surfaces being deployable between a stowed position and a deployed position. The hull conversion assembly may include a port side adjustable water diverting surface and a starboard side adjustable water diverting surface each having a plurality of water diverting plates, each of the water diverting plates having a deck face, a water face, a front edge, a port edge, a starboard edge, and a trailing edge. The plurality of water diverting plates may be pivotally and/or slidably attached to adjacent plates on the plates port edge, starboard edge. The hull conversion assembly when in a deployed position may have a port side outer portion that contacts a port side float of the watercraft, and a starboard outer portion contacts a starboard side float of the watercraft. The method may include retracting the hull conversion assembly to a stowed position at or near the central structure of the multihull watercraft. The deployment mechanism for the hull conversion assembly may include a kinematic chain assemblage, at least one primary linear actuator having one proximal end pivotally attached to the underside of the multihull watercraft, and one distal end slidably and pivotally attached to a dynamic attachment affixed to the water diverting surface, and at least one secondary linear actuator between adjacent plates of the hull conversion assembly, having one proximal end pivotally attached to a deck face of a first plate, and one distal end slidably and pivotally attached to a second plate. The kinematic chain assemblage may include a series of linkages and mechanisms operable to cooperate with the linear actuators to expand the water diverting plates on a predetermined path from the stowed position to the deployed position. The kinematic chain assemblage may be attached between adjacent plates of the water diverting surface, and intermediately attached between the water diverting surface and the underside of a midline of the watercraft. The method may include modifying the angle of the water diverting surfaces with respect to a deck of the watercraft. The single hull configuration may be operable to lift the forward bow to squat the multihulled watercraft when in a planing mode, and generate a surfable wake. The hull conversion assembly may include a frontal water diverting plate for redirecting water and deploying sealing a front edge of the water diverting surface. The frontal water diverting plate may have a curved geometry, and may be rotatably connected to the underside of the multihull watercraft, and operable to seal the front edge of the water diverting surface at its front edge. The frontal water diverting plate may have an initial position for allowing a clearance of the hull conversion assembly deployment and final position for the sealing the front edge of the hull conversion assembly. The method may include using a graphical user interface to direct an electronic controller to deploy the hull conversion assembly. The method may include using an electronic controller to activate deployment mechanism to deploy hull conversion assembly from the stowed position to the deployed position to adjust a pitch of the watercraft with respect to the waterline during motion. The hull conversion assembly may be operable to deploy when the watercraft is statically positioned, in the water moving, and when out of the water. The method may include positioning at least one pivoting trimming device between a deployed and non-deployed position using an electronic controller. The at least one trimming device functions to redistribute the force of the water on multihull watercraft and overcome the squat angle of the multihull watercraft when in a displacement and planing mode. The multihull vessel may be operable to pull skiers when the hull conversion assembly is in the deployed position.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
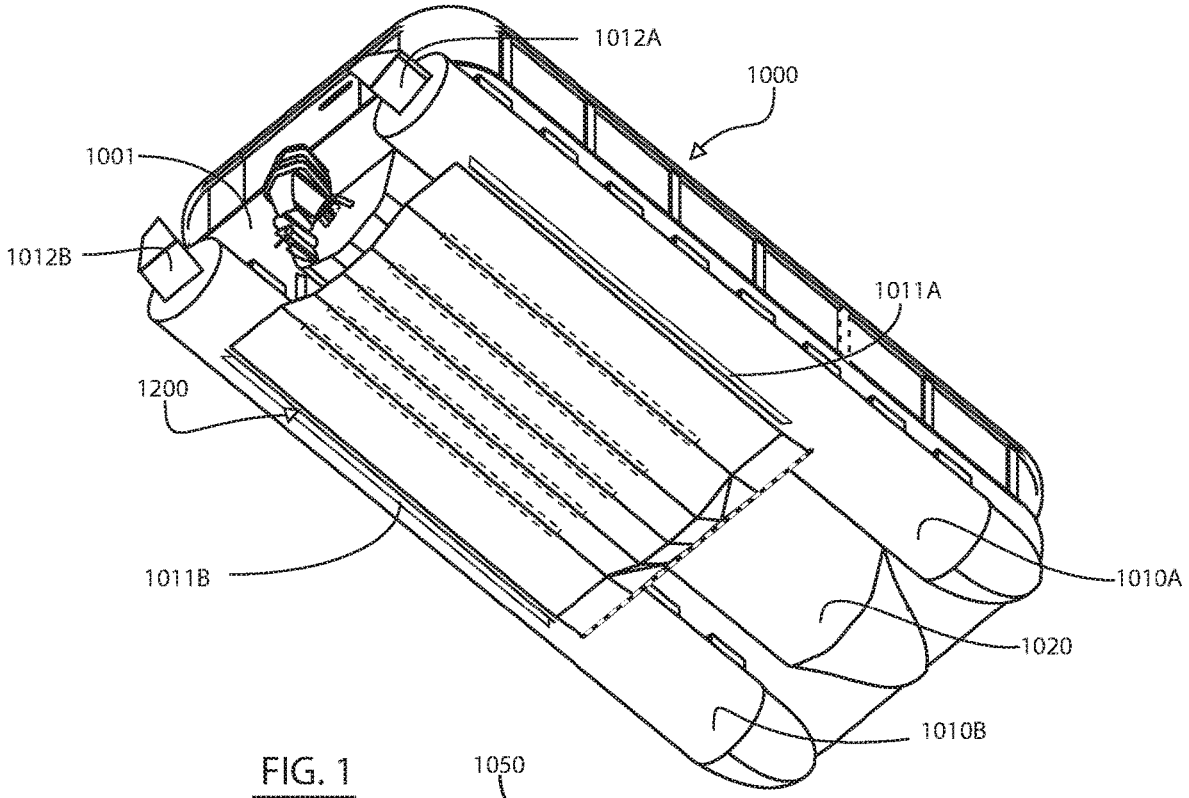
FIG. 1 provides a perspective view of an adjustable running surface, according to an embodiment of the present invention.
Figure 2:
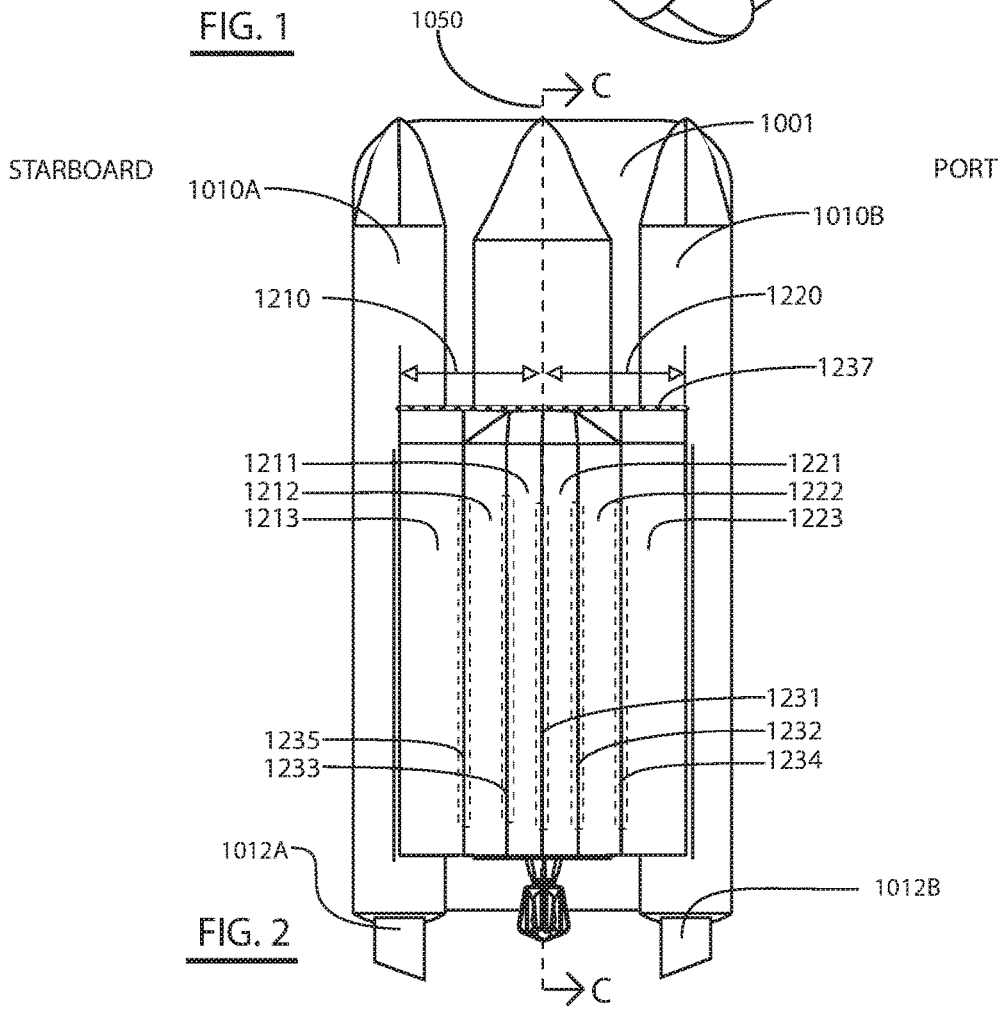
FIG. 2 provides a bottom view of an adjustable running surface, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. On the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

The present invention concerns an adjustable running surface apparatus that may be incorporated into a multi-hulled watercraft or pontoon watercraft. FIGS. 1-6 provide views of an exemplary pontoon-style watercraft 1000 incorporating a deployable and adjustable running surface 1200 according to the present invention, and deployment methods thereof. The exemplary pontoon-style watercraft 1000 may be a flattish boat with a shallow draft that relies on floats to remain buoyant for transporting lake goers. The adjustable running surface 1200 may attach to the base of the watercraft 1000 below the draft of the waterline ideally centered about the centerline 1050, and extending out to a port float 1010A and starboard float 1010B.

According to an embodiment of the present invention, the watercraft 1000 may be a multihull design that includes a deck 1001, which securely anchors a pair of floats 1010 that are symmetrically placed about the deck's 1001 centerline 1050 to the far ends of the deck. The pair of floats 1010 including, a portside float 1010A and a starboard side float 1010B. The floats 1010 may have a float tab 1011 that may be tangent to the float surface at the location of the inmost depth. A center float 1020 may be affixed to the deck midway of the pair of floats 1010 having a keel of the center float 1020 in line with the centerline 1050. The pair of floats 1010 may have a trim tab 1012 attached astern to the float, the trim tabs including a port trim tab 1012A and starboard trim tab 1012B. The watercraft 1000 may propel through the fluid with an outboard engine 1030. The floats 1010 may be capable of keeping the watercraft 1000 afloat while maintaining a small depth and producing a comfortable ride with a limited wake generated by the natural geometry of the floats 1010 and the trim tabs 1012. The portion of the floats 1010 and center float 1020 submerged below the waterline to keep the watercraft afloat is the initial running surface.

The adjustable running surface 1200 may include a starboard side array 1210 and port side array 1220 of water diverting plates that may have an asymmetrical relationship about the centerline 1050 of the watercraft. A starboard side array 1210 including, a first water diverting plate 1211, a second water diverting plate 1212, and a third water diverting plate 1213. The first water diverting plate 1211 may attach on the port side edge of the diverting plate to a joint 1231 and may be tangentially affixed to the keel of the watercraft on the center float 1020. Acting off the starboard side of the first water diverting plate 1211 may be a joint 1233 connecting the plates port side edge to a second water diverting plate 1212, a third water diverting plate 1213 may attach to a joint 1234, at the port edge, to the starboard edge of the second water diverting plate 1212. The third water diverting plate 1213 may be capable, on the starboard side edge, to seal into the starboard side float tab 1011B of the starboard float 1010B. Equivalently, a portside array including, a first water diverting plate 1221, a second water diverting plate 1222, and a third water diverting plate 1223. A first water diverting plate 1221 may attach on the starboard side edge of the diverting plate to a joint 1231, the diverting plate 1221 connected on the port side to a second water diverting plate's 1222 starboard side edge via a joint 1232. A third water diverting plate 1223 may attach to a joint 1235, at the starboard edge, to the port edge of the second water diverting plate 1222. The third water diverting plate 1223, on the port side edge, may be capable of sealing into the port side float tab 1011A of the port side float 1010A. A frontal diverting plate 1230 having a pitch that may orient into an asternal angle and may have an acute edge 1230A for sealing the port and starboard side array of plates 1220, 1210; the frontal diverting plate 1230 may attach to the deck 1001 via a joint 1236.

The individual plates of the starboard side array 1210, port side array 1220, and frontal water diverting plate 1230 when deployed coalesce into a uniform surface and may be arrange to mimic the running surface of a V-hull type watercraft and gain the benefits and drawbacks of the V-hull geometry. The adjustable running surface 1200 may arrange the frontal diverting plate 1230 perpendicular to the bow and attached forward of midship. The adjustable running surface 1200 may be configured to have a sternmost edge resolving between midship and the stern; in some embodiments the sternmost edge of the adjustable running surface may extend to the transom of the watercraft.

Figure 3:
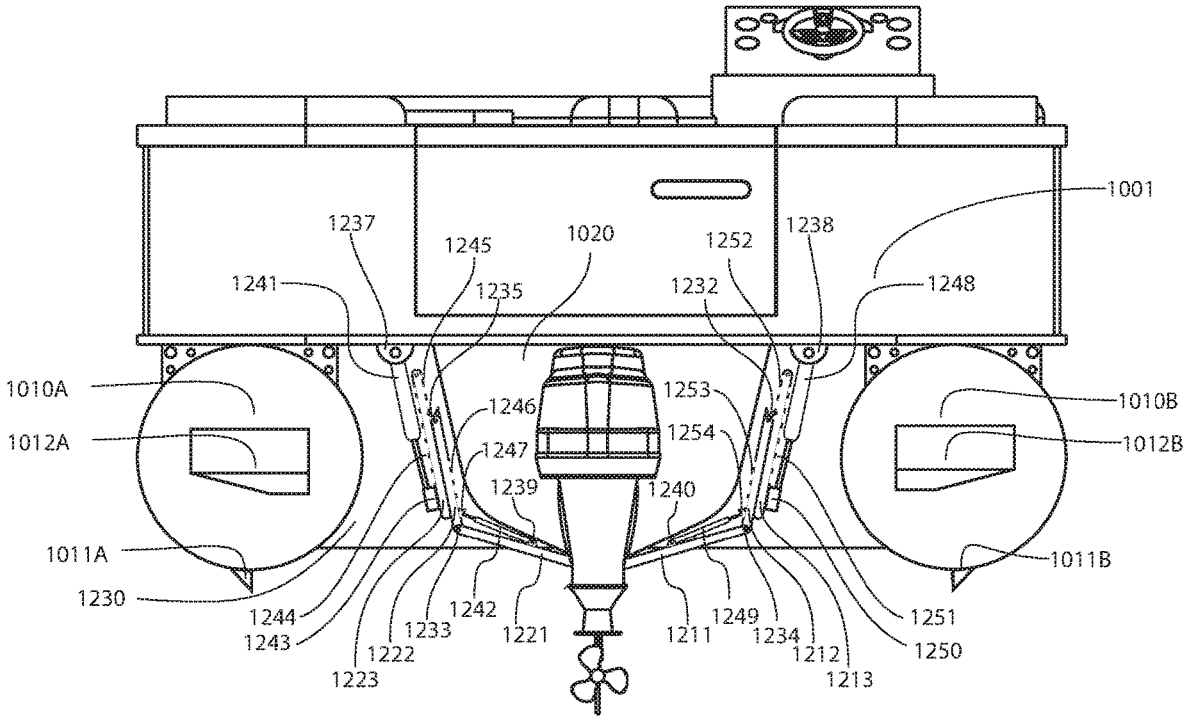
FIG. 3 provides a rear view of an adjustable running surface in the stowed position, according to an embodiment of the present invention.
Figure 4:
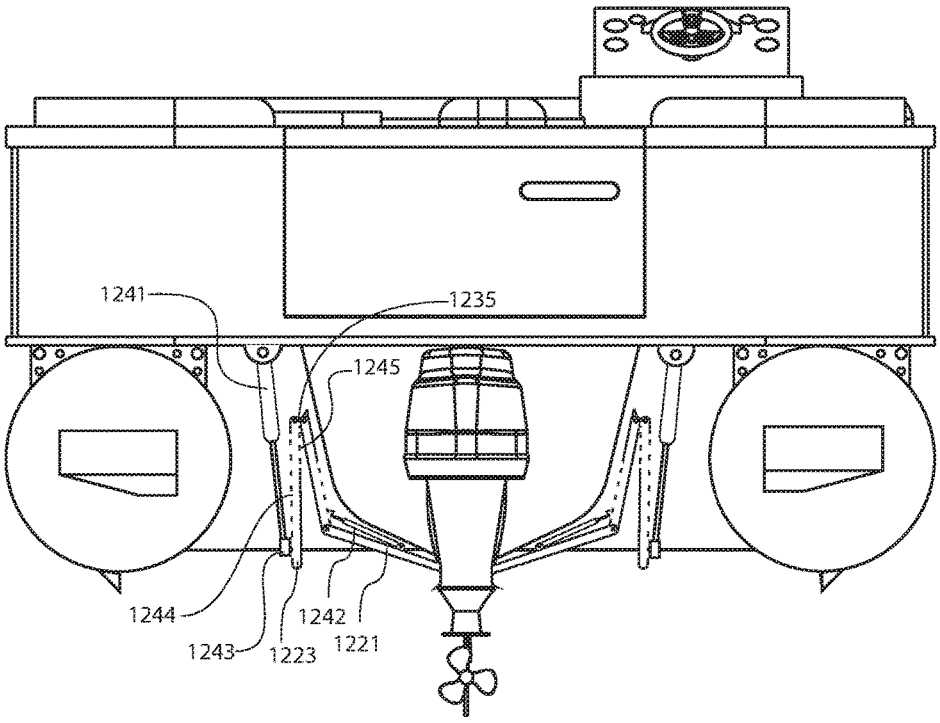
FIG. 4 provides a rear perspective view of intermediary configuration for deployment of an adjustable running surface, according to an embodiment of the present invention.

FIG. 3 provides an exemplary view of the watercraft 1000 and the adjustable running surface 1200 in the stowed position. The adjustable running surface 1200 and the various plates may deploy with a system of linkages, slots, pins, and actuators. The deployable system having mechanisms that are Asymmetrical about the centerline 1050 for both the port side and starboard side array of water diverting plates 1210, 1220. The port side deployable system including a pinned deck flange 1237, a pinned diverting plate flange 1239, a first actuator 1241, a second actuator 1242, a first carriage 1243, a first slide 1244, second slide 1245, third slide 1246, and a second carriage 1247. Conversely, the starboard side deployable system including a pinned deck flange 1238, a pinned diverting plate flange 1240, a first actuator 1248, a second actuator 1249, a first carriage 1250, a first slide 1251, a second slide 1252, a third slide 1253, and a second carriage 1254. The dashed lines illustrate the slides and slots of the water diverting plates.

Regarding the port side, the pinned deck flange 1237 may be operable to receive the first actuator 1241 and allow for rotation about the central axis of the pin. The first carriage 1243 may attach to the first actuator 1241 and may be operable to nest a slide 1244 that may attach to the port side deck face of the third water diverting plate 1223. The slot 1245 may attach to the surface face of the third water diverting plate 1223 and may be operable to receive a pin that may be attached to the joint 1235 and operates in a pin-in-slot joint fashion. The second slot 1246 may attach to the deck face of the second port side water diverting plate 1222 and may be operable to receive a second carriage 1247. The second carriage 1247 may be actuated by a second actuator 1242 secured to the first port side water diverting plate 1221 on the deck face with a pinned flange 1239.

Symmetrically, on the starboard side, the pinned deck flange 1238 may be operable to receive the first actuator 1248 and allow for rotation about a central axis of the pin. The first carriage 1250 may attach to the first actuator 1248 and may be operable to nest into a slide 1251 that may be affixed to the deck face of the starboard side third water diverting plate 1213. The slot 1252 may attach to the surface face of the third water diverting plate 1213 and may be operable to receive a pin that may be attached to the joint 1232 and operates in a pin-in-slot joint fashion. The second slot 1253 may further attach to the deck face of the second starboard side water diverting plate 1212 and may be operable to receive a second carriage 1254. The second carriage 1254 may be actuated by a second actuator 1249 secured to the first starboard side water diverting plate 1211 on the deck face with a pinned flange 1240.

Figure 5:
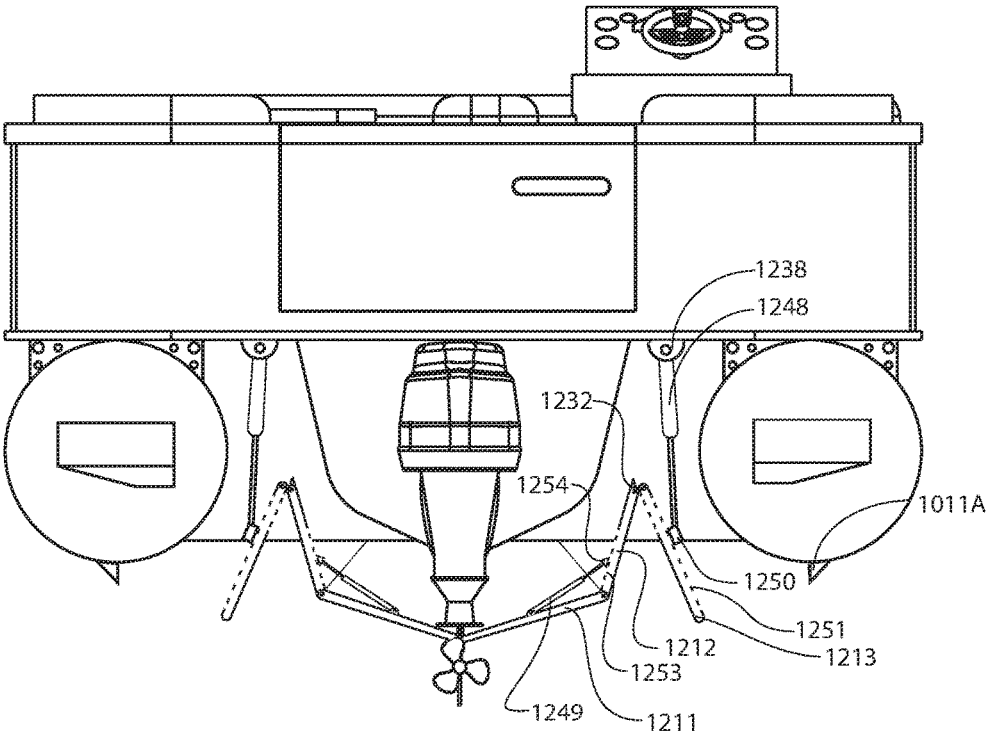
FIG. 5 provides a rear perspective view of another intermediary configuration for deployment of an adjustable running surface, according to an embodiment of the present invention.

When deploying the adjustable running surface 1200, the port and starboard side deployable mechanism operates in an Asymmetrical manner. As shown in the exemplary view of FIG. 4, The port side, when actuated by an operator, the first actuator 1241 may linearly extend simultaneously pushing the first carriage 1243 against the distal end of the slot 1244 of the third water diverting plate 1223 on the deck side and invoking the pin of joint 1235 to slide within the slot 1245. The linear actuation of the first actuator 1241 ceases temporarily when the pin of joint 1235 has joined the starboard side edge of the third water diverting plate to the portside edge of the second water diverting plate 1222. An intermediary step for deployment of the water diverting surface is shown in FIG. 5 following a ceasing of the first actuator 1248, the second actuator 1249 linearly extends and slides the second carriage 1254 from port to starboard on a path adjacent to the slot 1253, and the first carriage 1250 slides from starboard to port and rotates the first linear actuator 1248 about the pinned deck flange 1238. The first actuator 1248 re-engages when central axis is perpendicular to the deck 1001 and continues to extend linearly, and the first carriage 1250 continues to slide port to starboard in the slot 1251. The first and second actuators 1248, 1249, move uniformly and continue to slide their respective carriages 1250, 1254, and along their slot paths 1251, 1253. The first and second actuators 1250, 1254 halt their motion once the starboard edge of the third water diverting plate 1213 has seated into the starboard float tab 1011B.

Figure 6:
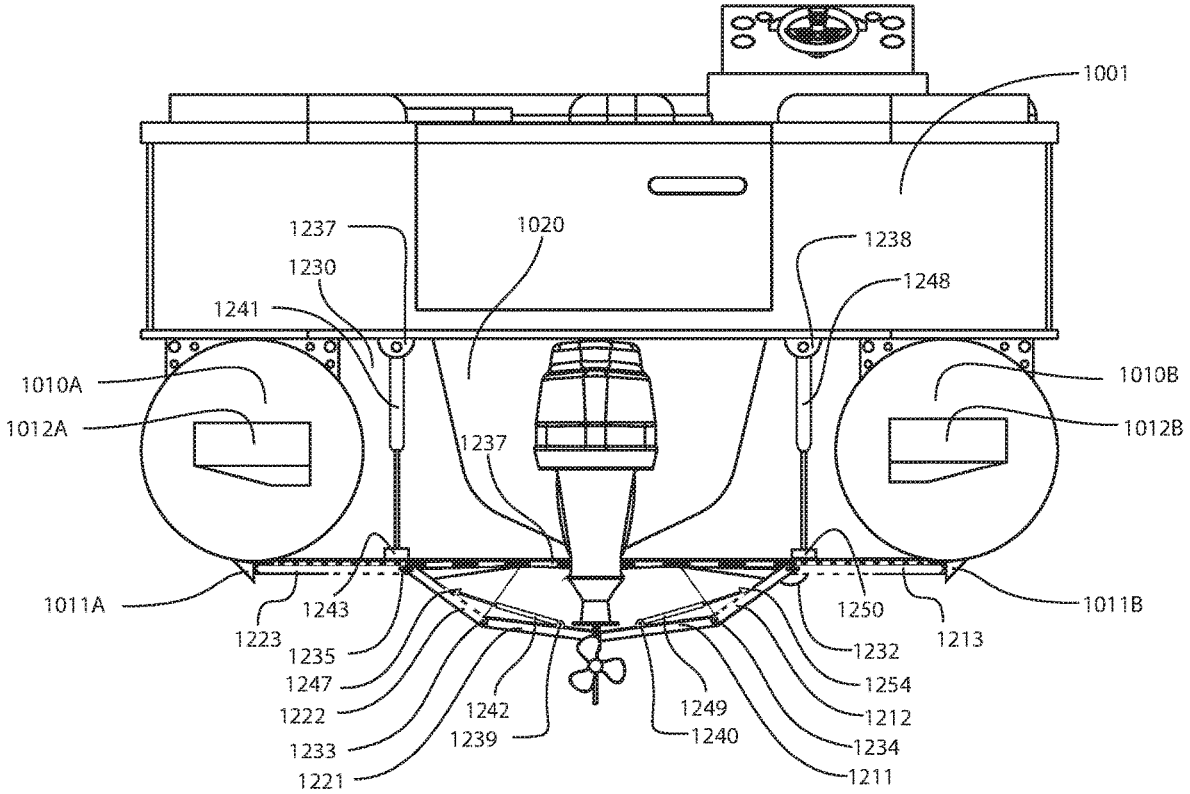
FIG. 6 provides a rear perspective view of an adjustable running surface in the deployed position, according to an embodiment of the present invention.

FIG. 6 provides an exemplary view of the watercraft 1000 and the adjustable running surface 1200 in the deployed configuration. The port side array 1220 shown in the fully extended configuration in which it may coalesce to form a singular surface and may seal the portside edge of the third water diverting plate 1223 with the port side float tab 1011A. The starboard side array 1210 shown in the fully extended configuration in which it coalesce to a singular surface and may seal with the starboard side edge of the third water diverting plate 1213. The linear actuators 1241 and 1248 are in the fully extended positions and may be operable to support and assist in absorbing forces applied to the hull of the system.

Figure 7:
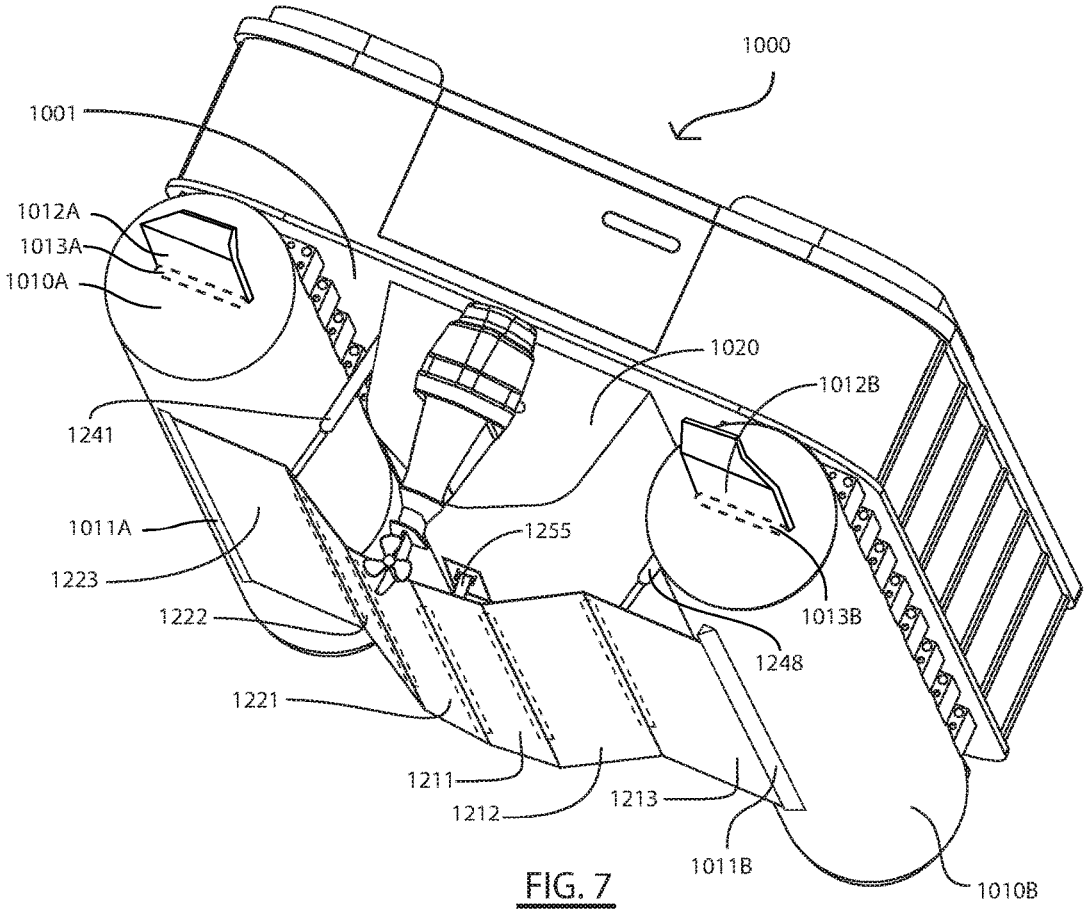
FIG. 7 provides a side view of an adjustable running surface, according to an embodiment of the present invention.

FIG. 7 provides an exemplary perspective view of the watercraft 1000 and the variable running surface 1200 of another embodiment. The variable running surface 1200 in the deployed configuration is illustrated, and the various water diverting plates form a singular surface. The deployment actuators, including the port side linear actuator 1241, starboard side linear actuator 1248, and a center actuator 1255 are in the fully extended configuration. The port side and starboard side trim tabs 1012A, 1012B may have a joint 1013A, 1013B enabling the actuation and variable trim tab orientations about the stern of the port side and starboard side floats 1010A, 1010B. The actuation of the systems may utilize actuators types similar to the deployment actuators.

Figure 8:
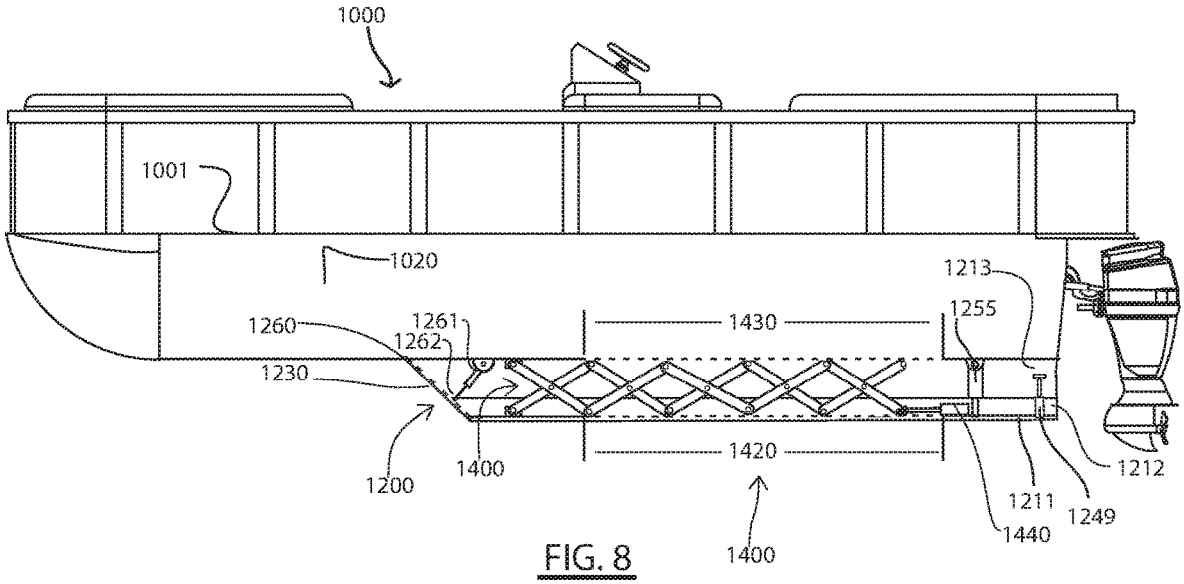
FIG. 8 provides a front view of an adjustable running surface, according to an embodiment of the present invention.

In some embodiments, it may be advantageous for the system to have and additional lifting mechanism 1400 for assisting deployment of the variable running surface 1200, and adding redundancy to increase rigidity and strength of the system. FIG. 8 provides a possible implementation of the lifting mechanism 1400, and illustrates an exemplary port side view of the watercraft 1000 and a cross-sectional view of the surfaces below deck up to the centerline 1050; the surfaces including the initial running surface (e.g., port side float 1010B and center float 1020), and the initial running surface 1200. The additional lifting mechanism 1400 comprises a series of linkages moveable relative to the variable running surface 1200 and the keel of the center float 1020. Attached to the keel of the center float 1020 an array of keel slides 1430 may be nested within or on the keel of the center float 1020. Attached to the centerline of the variable running surface 1200 an array of surface slides 1420 may be attached to the deck face of the variable running surface 1200.

Figure 9:
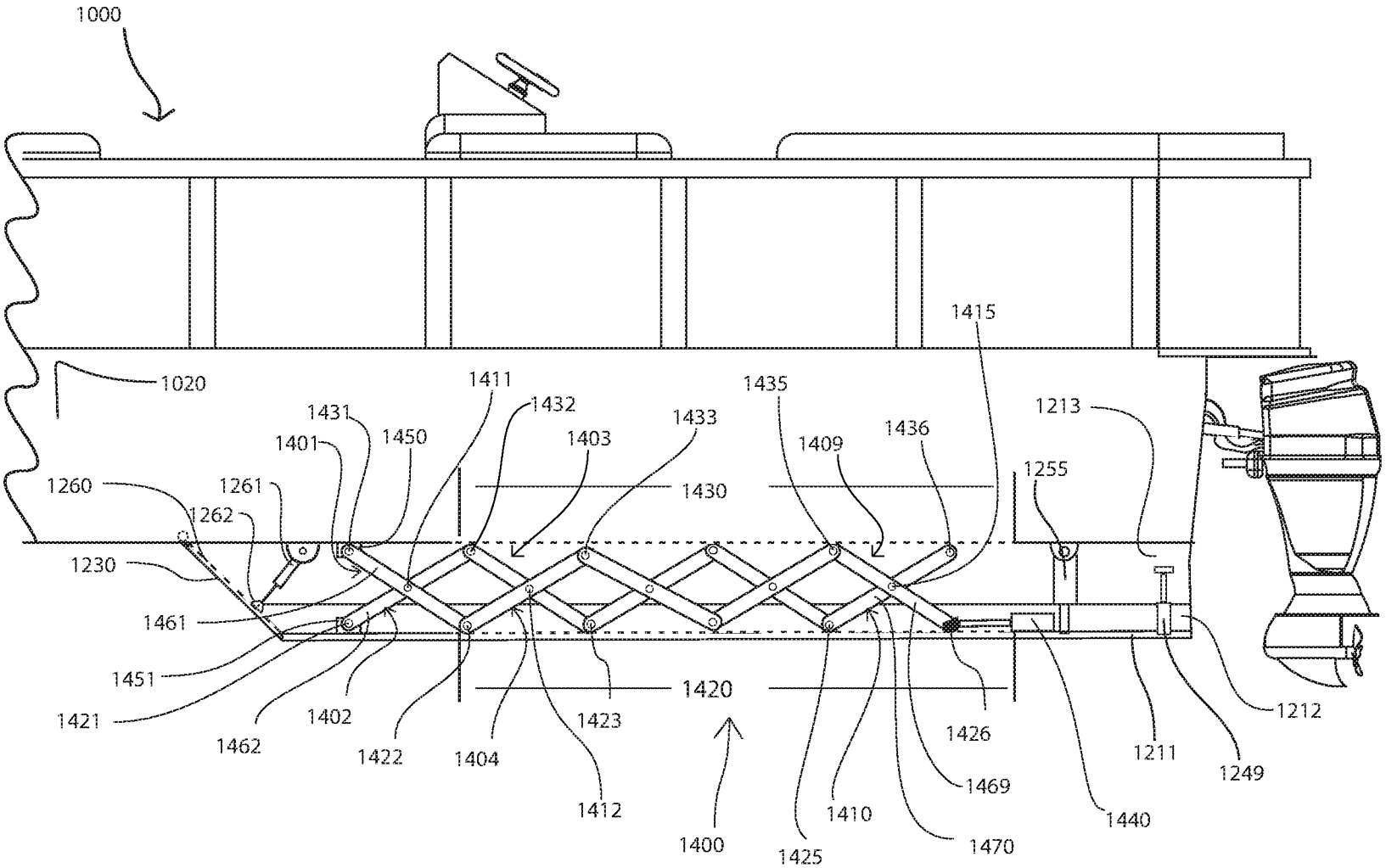
FIG. 9 provides a cross-sectional side view of an adjustable running surface, according to an embodiment of the present invention.

FIG. 9 provides a side view of the water craft 1000 and the lifting mechanism 1400 comprising a kinematic chain of equivalent members. A first pair of members 1401, 1402 in the lifting system 1400 having the mechanical advantage of a sliding rocker arm. The first link 1401 having one end 1431 pivotally attached, with a flange 1450 to the keel of the center float 1020, the second end 1422 slidably and pivotally attached to surface slide 1420 at joint 1432, and an intermediate surface 1461 therebetween; a second link 1402 having one end pivotally attached to a flange 1451 about the centerline of the variable running surface 1200, the second end slidably and pivotally attached keel slide 1430 at joint 1432, and an intermediate surface 1462 therebetween. The second link 1402 may traverse the first link 1401, and the intermediate surfaces 1461, 1462 of the first link 1401, and second link 1402 are pivotally connected about a shaft 1411. The flanges 1450, 1451 are grounded with a fixed fastener about to the keel of the center float 1020 and centerline of the variable running surface 1200 and only allow for pivotal motion.

A second pair of members 1403, 1404 in the lifting mechanism 1400 sharing the attachment locations of the first pair of members 1401, 1402, and acquiring the mechanical characteristics of their attached location and translating any force inputs through the second pair of members 1403, 1404 to the first pair of members 1401, 1402. The third link 1403 has one end 1432 pivotally attached to the second link 1402 at the slidably and pivotally attached first end 1432, the second end 1423 slidably and pivotally attached to the surface slide 1420, and an intermediate surface 1463 therebetween; a fourth link 1404 having one end 1422, pivotally attached to the first link 1401 at the slidably and pivotally attached first end 1422, the second end 1433 slidably and pivotally attached to the keel slide 1430, and an intermediate surface 1464 therebetween. Alike the first pair of members 1401, 1402, the third link 1403 may traverse the fourth link 1404 and the intermediate surfaces 1463, 1464 of the third link 1403 and fourth link 1404 are pivotally connected about a shaft 1412. The subsequent linkages in the lifting system are attached in an equivalent fashion to the second pair of members 1403, 1404, and deploy symmetrically.

The lifting mechanism 1400 includes a sternmost pair of lifting members 1409, 1410, that are operable to receive on the sternmost side an input force. From the stern, a first link 1410 having one end joint 1436 slidably and pivotally attached to the keel slide 1430, the second end slidably and pivotally attached to the surface slide 1420 at joint 1425, and an intermediate surface 1470 therebetween; a second link 1409 having a first end 1426 affixed to a cleaves and pin of the actuator 1440, the second end slidably and pivotally attached to the keel slide 1430 at joint 1435, and an intermediate surface 1469 therebetween. Alike formerly described members 1401, 1402, 1403, and 1404 the first link 1409 traverses the second link 1410 and the intermediate surfaces 1469, 1470 of the ninth link 1409 and tenth link 1410 are pivotally connected about a shaft 1415.

In operation, the lifting mechanism 1400 of the present invention may be operable to the lift the configuration through actuation of the linear actuator 1440 causing the assemblage of members in the lifting system 1400 to kinematically react by translating the input force of the sternmost pair of lifting members 1409, 1410 through the kinematic chain to the grounded flanges 1450, 1451 of the first member group 1401, 1402, and generally elevating the variable running surface 1200 off of the keel of the center float 1020 of the watercraft 1000.

Figure 10:
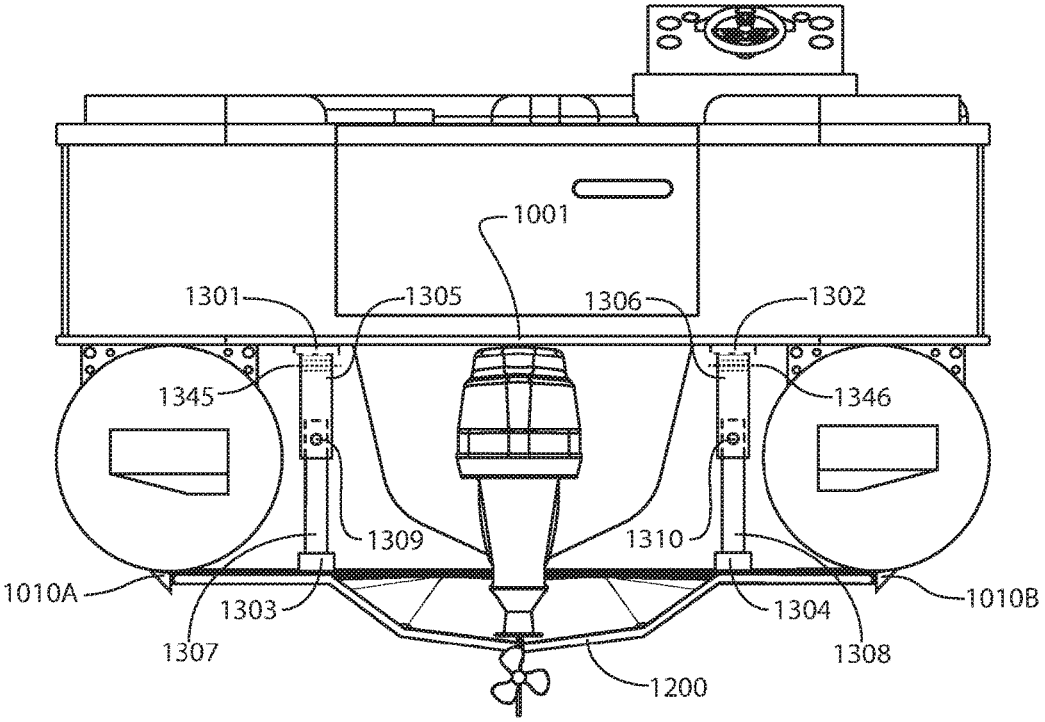
FIG. 10 provides a rear view of an adjustable running surface, according to an embodiment of the present invention.

FIG. 10 provides an exemplary view of the watercraft 1000 and the variable running surface 1200. The variable running surface 1200 in a fixed configuration, may attach to the deck face 1001, with a frame 1300. The port side telescopic rail system including a deck rail 1305, a running surface rail 1307, a pin 1309, mounting foot 1303, and bracket and devises pin 1301. The starboard side telescopic rail system including a deck rail 1306, a running surface rail 1308, a pin 1310, mounting foot 1304, and bracket and devises pin 1302. The watercraft 1000 when out of the water may have the brackets 1301 and 1302 attached to the deck face 1001, and the deck rails 1305 and 1306 may be pinned to the brackets 1301 and 1302. The variable running surface 1200 may have a mounting feet 1303 and 1304 attached to the variable running surface's inner face, and a running surface rails 1307 and 1308 may be fastened to the mounting feet 1303 and 1304. The variable running surface 1200 may then be attached to the watercraft 1000 by sliding the variable running surface rails 1307 and 1308 into the deck rails 1305 and 1306. When the rail system is configured into the final position, pins 1309 and 1310 may secure the two rails together in a fixed configuration. The frame 1300 may have a plurality of telescopic rails that may be in line with each other and parallel to the centerline of the watercraft. In some implementations, a series of trusses may connect the plurality of telescopic rails.

Figure 11:
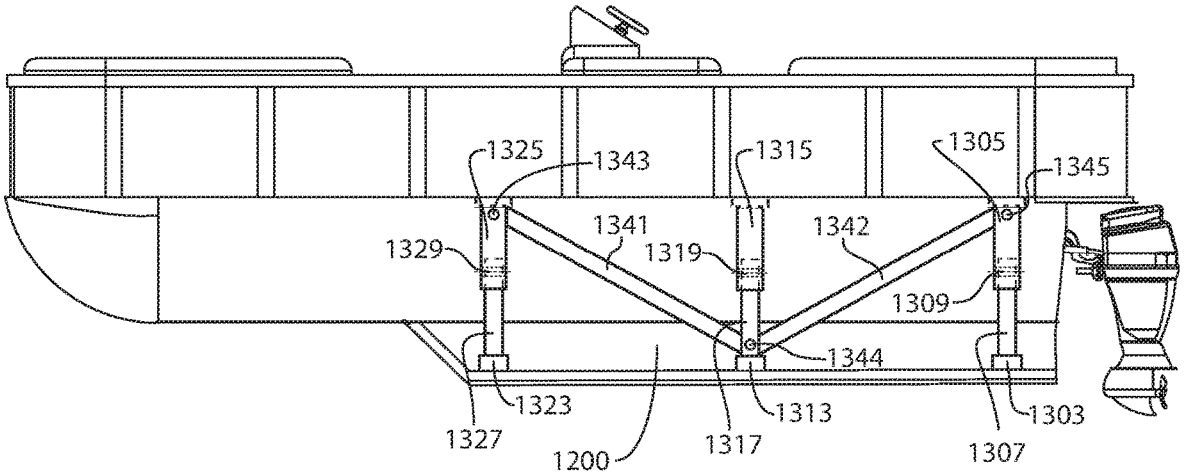
FIG. 11 provides a side view of an adjustable running surface, according to an embodiment of the present invention.

FIG. 11 provides an exemplary side view of a portside cross-sectional view of the watercraft 1000 and the adjustable running surface 1200. The cross-sectional view exposes the port side frame 1300 and the plurality of telescopic rails comprised of the deck side rails 1305, 1315, and 1325, and the running surface rails 1307, 1317, and 1327. The system of telescopic rails may have an inline arrangement with each other and may be substantially parallel to the centerline of the watercraft. The plurality of telescopic rails may have characteristics to reinforce the stability of the frame with trusses 1341 and 1342. The truss 1341 may fasten on one end to the deck side rail 1325 at the pinned location 1343 and to the running surface rail 1317 at the pinned location 1344. The truss 1342 may attach to the running surface rail 1317 at the pinned location 1344 and the deck side rail 1305 at the pinned location 1345. The system, when assembled, may be a frame 1300 operable to secure the adjustable running surface 1200 to the watercraft 1000.

Figure 12:
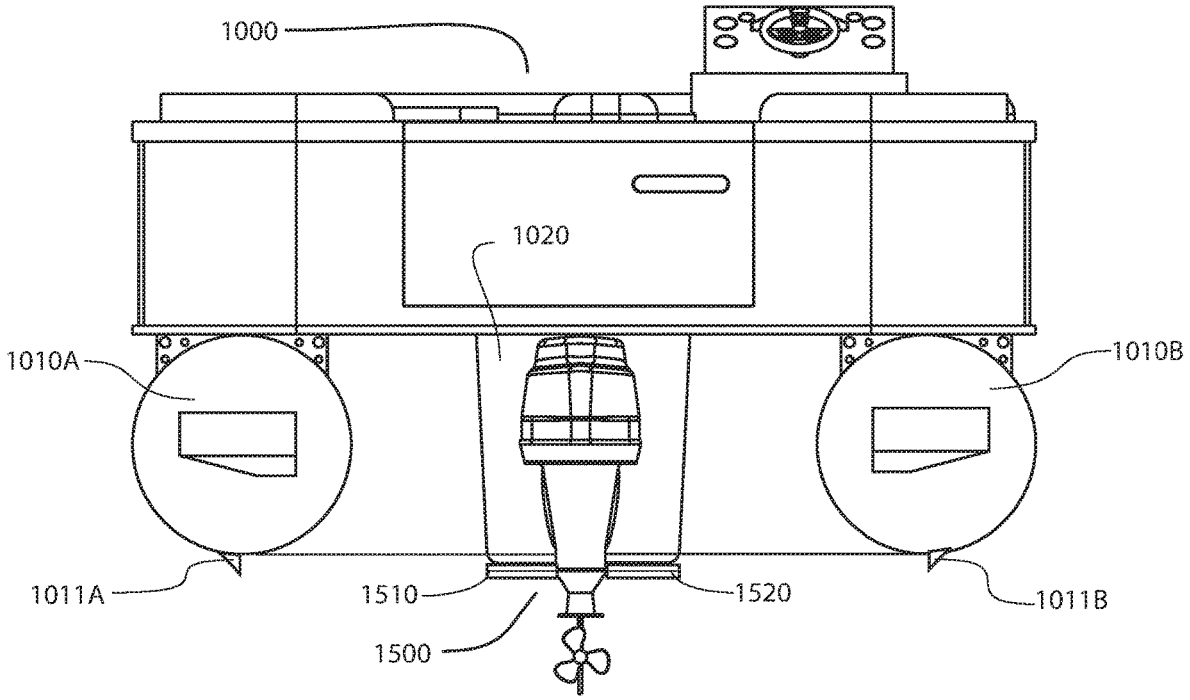
FIG. 12 provides a rear perspective view of an adjustable running surface in the stowed position, according to an embodiment of the present invention.
Figure 13:
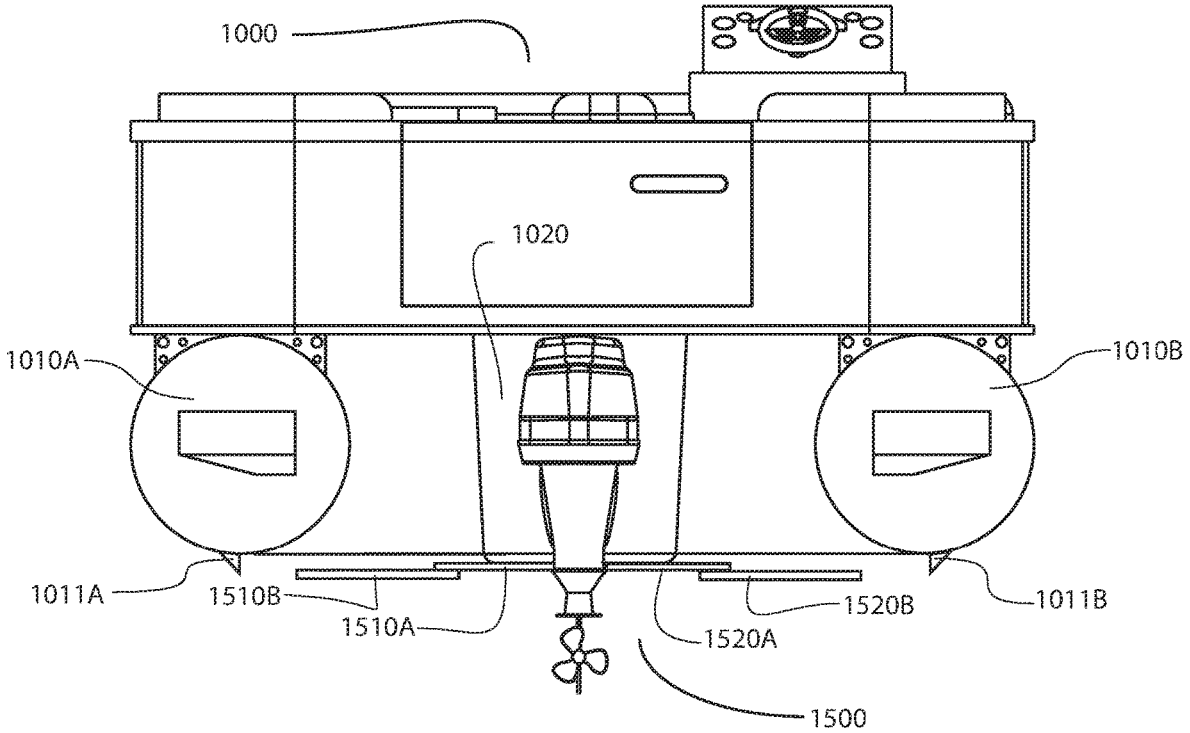
FIG. 13 provides a rear perspective view of intermediary configuration for deployment of an adjustable running surface, according to an embodiment of the present invention.
Figure 14:
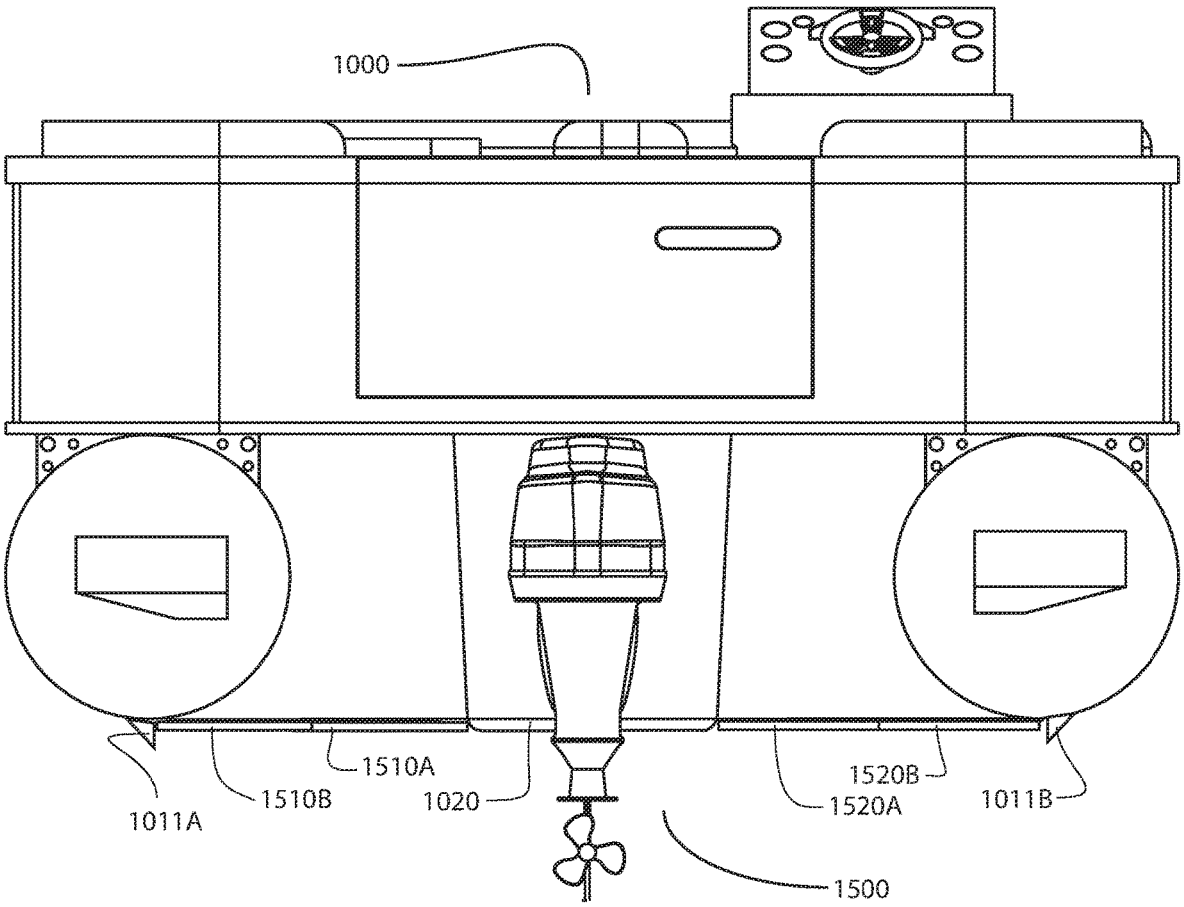
FIG. 14 provides a rear perspective view of an adjustable running surface in the deployed position, according to an embodiment of the present invention.

In some embodiments, the adjustable running surface 1200 may be configured from a stack of water diverting plates that are nested in the underside of a center float 1020 such as the configuration illustrated in FIGS. 12-14. The stack of water diverting plates may have a portside stack 1510 and a starboard side stack 1520. The portside stack 1510 may include a first plate 1510A slidably secured to the underside of the center float 1020 and operable to slidably secure a second plate 1510B on the under face of the first plate 1510A. The starboard stack 1520 may include a first plate 1520A slidably secured to the underside of the center float 1020, and operable to slidably secure a second plate 1520B on the under face of the first plate 1520A. FIG. 12 illustrates the adjustable running surface 1500 in the stowed position, and the stack of plate 1510, 1520 having a low-profile within the center float 1020.

The deployed position, illustrated in FIG. 14, may configure the stack of plates in a substantially planer configuration and inline with the center float 1020. On the portside, the first plate 1510A may have a starboard edge laterally in contact with the portside of the center float 1020, and portside edge of the first plate 1510A may link to the second plate 1510B starboard edge. The portside edge of the second plate 1510B may be laterally in contact with the portside float 1010A. The starboard side first plate 1520A may have a portside edge laterally in contact with the starboard side of the center float 1020, and the starboard side edge of the first plate 1520A may link to the second plate 1520B portside edge. The starboard side of plate 1520B may laterally rest on the portside float 1010B. The deployed configuration transforms the multihull watercraft 1000 to have a substantially planer water diverting surface and may increase performance in planning operations.

FIG. 13 illustrates the stack of plates 1510, 1520 in an intermediary position from the stowed to the deployed position. On the portside stack of plates 1510 the first plate 1510A and the second plate 1510B may be actuated from starboard to port, and on the starboard side, the first plate 1520A and second plate 1520B may be actuated from port to starboard. The actuation of the portside stack 1510 and starboard side stack 1520, may simultaneously deploy and the first and second plates in the stacks 1510, 1520 may deploy steadily at different rates to the deployed configuration. The first plates 1510A, 1520A may be in contact with the underside of center float throughout the deployment process, and the second plates 1510B, 1520B may be in contact with the underside of the first plates. In some embodiments, the plates may telescopically deploy, having the first plates nested inside of the center float 1020, and the second plates nested inside of the first plate.

Figure 15:
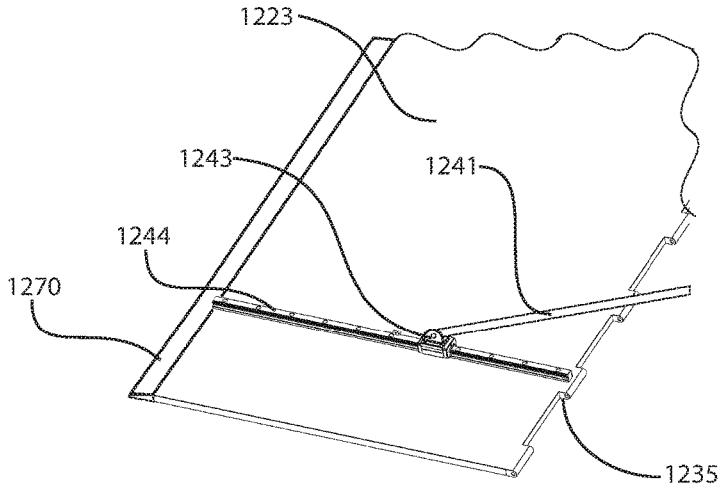
FIG. 15 provides a perspective view of a component of an adjustable running surface according, according to an embodiment of the present invention.

FIG. 15 provides an exemplary perspective cutout view of the third water diverting plate 1223 of the port side array of the adjustable running surface 1200. The cross-sectional view shows a carriage (e.g., hub) 1243 and rail (e.g., slot) system 1244 that may pivotally attach to the linear actuator 1241. The carriage 1243 may be operable to slide along the rail 1244 freely, and the linear actuator may freely rotate about the carriage pin. In some embodiments, the rail 1244 may be embedded into the water diverting plate 1223. The carriage 1243 may have a ball bearing interior wall to allow for slip along the rail. The carriage 1243 and rail 1244 may have a material construction of aluminum, steel, ceramics, plastics, and fiberglass composites. In some implementations, the carriage 1243 and rail 1244 may be curved and non-linear to assist in timing the deployment to prevent interference with adjacent plates and the underside of the watercraft.

Figure 16:
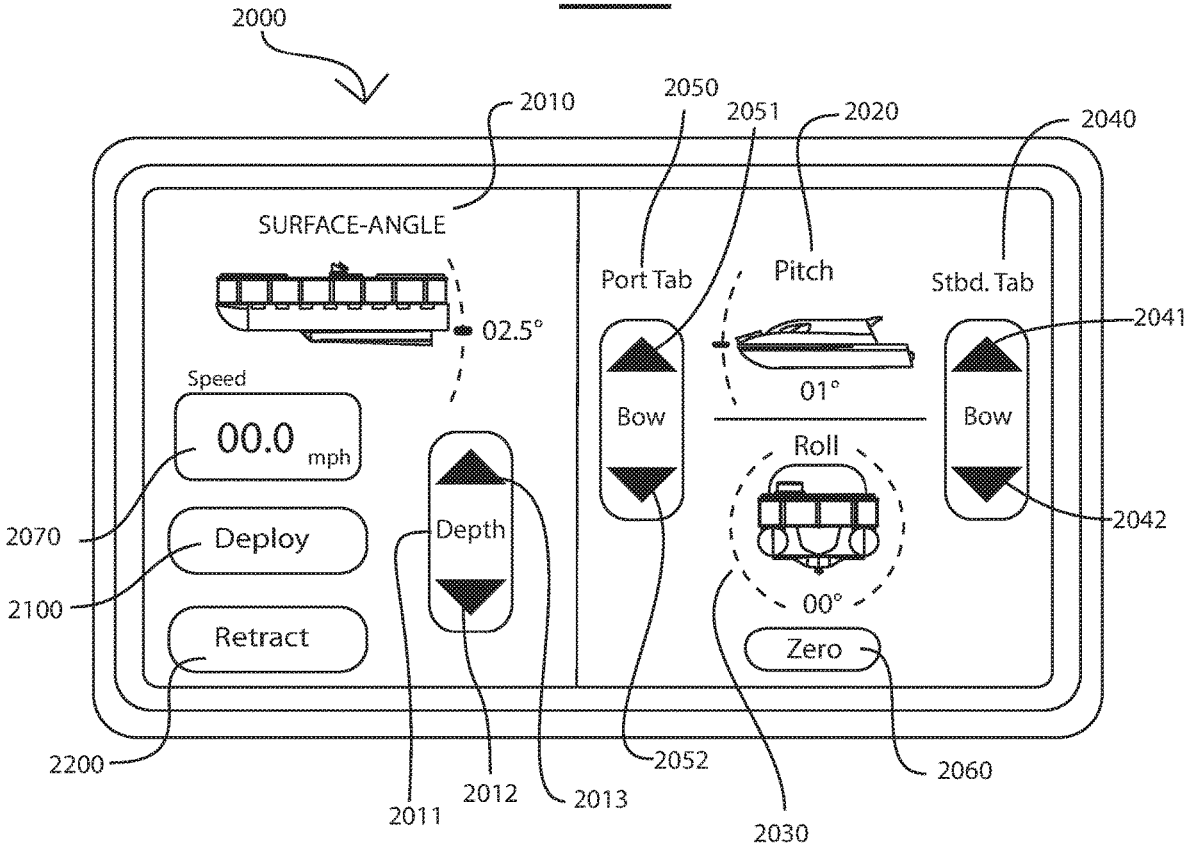
FIG. 16 provides an exemplary view of a graphical user interface, according to an embodiment of the present invention.

FIG. 16 provides an exemplary view of a graphical user interface 2000 that may be operable to control the various actuated systems of the watercraft 1000. The graphical user interface including a surface angle graphic 2010, pitch angle 2020, roll angle 2030, port tab controller 2050, starboard tab controller 2040, surface angle controller 2011, variable surface deployment button 2100, and a variable surface return button 2200. The variable running surface 1200 may deploy when a user enables the deploy button 2100, the graphical user interface may display the measured speed 2070, and a controller may determine if the speed falls within the allowable range for safe deployment. A surface angle graphic 2010 may be displayed and the angle of the variable running surface with respect to the deck 1001 of the watercraft 1000. A user may modify the surface angle 2010 with the surface angle controller 2011 by increasing the depth 2013 and decreasing the depth 2012 with the buttons 2012, 2013. A pitch angle graphic 2020 and roll angle 2030 may be displayed to the user and may be modified by adjusting the port side trim tab 1012A, and starboard trim tab 1012B angles, by adjusting the port tab 2050 controller and starboard tab controller 2040. The port tab controller 2050 may have an angle increase 2051 button, and angle decrease 2052 button, the starboard tab controller 2040, may have an angle increase 2041 button, and angle decrease 2042 button. The trim tabs may zero with the button 2060.

CONCLUSION/SUMMARY

The present invention provides an adjustable running surface, that is substantially variable and operable to modify the hull geometry of a watercraft, more specifically multihull watercraft for the generation of a surfable wake. The present invention is able to deploy a water diverting surface that functions to lift the forward bow and squat a watercraft into the water depths for generation of a surfable wake. It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A hull conversion assembly for a multihull watercraft, comprising:

a. a deployable hull conversion assembly comprising water diverting surfaces movably secured to a centrally positioned pontoon of said multihull watercraft and operable to modify an underside of said multihull watercraft when deployed, said deployable water diverting surfaces being movable between a stowed position and a deployed position, wherein said water diverting surfaces include a plurality of articulating sections that conform around said centrally positioned pontoon when the hull conversion assembly is in the stowed position; and b. a deployment mechanism for deploying the water diverting surfaces to said deployed position to transform the hull geometry of said multihull water craft to a single hull configuration.

2. The assembly of claim 1, wherein said deployable hull conversion assembly includes a port side adjustable water diverting surface and a starboard side adjustable water diverting surface each having a plurality of water diverting plates, each of said water diverting plates having a deck face, a water face, a front edge, a port edge, a starboard edge, and a trailing edge.

3. The assembly of claim 2, wherein each of said plurality of water diverting plates is pivotally attached to adjacent plates on said plates port edge, starboard edge.

4. The assembly of claim 2, wherein said deployment mechanism includes a kinematic chain assemblage, at least one primary linear actuator having one proximal end pivotally attached to the underside of said multihull watercraft, and one distal end slidably and pivotally attached to said water diverting surface, and at least one secondary linear actuator between adjacent plates of said hull conversion assembly, having one proximal end pivotally attached to a deck face of a first plate, and one distal end slidably and pivotally attached to a second plate.

5. The assembly of claim 4, wherein said kinematic chain assemblage includes a series of linkages and mechanisms operable to cooperate with said linear actuators to expand said water diverting plates on a predetermined path from said stowed position to said deployed position.

6. The assembly of claim 1, wherein in said deployed position, said hull conversion assembly has a port side outer portion that contacts a port side float of said watercraft, and a starboard outer portion contacts a starboard side float of said watercraft.

7. The assembly of claim 1, wherein said deployment mechanism is operable to modify the angle of said water diverting surface with respect to a deck of said watercraft.

8. The assembly of claim 1, wherein said hull conversion assembly includes a frontal water diverting plate for redirecting water and sealing a front edge of said water diverting surface.

9. A hull-conversion device for a multihull watercraft, comprising:

a. a deployable hull conversion assembly comprising a plurality of articulating water diverting plates movably secured to a multihull watercraft and operable to modify an underside of said multihull watercraft when deployed, said plurality of water diverting plates being movable between a stowed position and a deployed position, wherein said plurality of water diverting plates include articulating sections that conform around a centrally positioned pontoon when the hull conversion assembly is in the stowed position, wherein said plurality of water diverting plates form a V-hull configuration for modifying the underside of said multihull watercraft when in a deployed position; and b. a frame for securing and positioning said water diverting surface to an underside of a deck of said multihull watercraft.

10. The device of claim 9, wherein said plurality of water diverting plates form a continuous surface in a V-hull shape when in said deployed position, having a port edge, and a starboard edge for sealing with a port side float and a starboard side float of said multihull watercraft.

11. The device of claim 9, wherein said frame comprises a plurality of members including an inner rail, an outer rail, and a crossmember; the outer rail section embracing the inner rail section for slidably engaging with the inner rail for telescopically adjusting the distance of said water diverting surface with said deck.

12. The device of claim 9, wherein hull-conversion device includes a frontal water diverting plate for redirecting water and sealing a front edge of said water diverting surface.

13. A method of converting a multihull watercraft to a single-hull watercraft, comprising:

a. positioning a hull conversion assembly to a stowed position in proximity to an underside of a multihull watercraft having a protruding central longitudinal structure, said hull conversion assembly having a plurality of articulating water diverting surfaces, wherein said plurality of articulating water diverting plates include articulating sections that conform around said protruding central longitudinal structure when the hull conversion assembly is in the stowed position; and b. deploying said hull conversion assembly to transform the hull geometry of said multihull water craft to a single hull configuration, said water diverting surfaces being deployable between a stowed position and a deployed position.

14. The method of claim 13, wherein said hull conversion assembly includes a port side adjustable water diverting surface and a starboard side adjustable water diverting surface each having a plurality of water diverting plates, each of said water diverting plates having a deck face, a water face, a front edge, a port edge, a starboard edge, and a trailing edge.

15. The method of claim 14, wherein each of said plurality of water diverting plates is pivotally attached to adjacent plates on said plates port edge, starboard edge.

16. The method of claim 13, wherein in a deployed position, said hull conversion assembly has a port side outer portion that contacts a port side float of said watercraft, and a starboard outer portion contacts a starboard side float of said watercraft.

17. The method of claim 13, wherein a deployment mechanism for said hull conversion assembly includes a kinematic chain assemblage, at least one primary linear actuator having one proximal end pivotally attached to the underside of said multihull watercraft, and one distal end slidably and pivotally attached to said water diverting surface, and at least one secondary linear actuator between adjacent plates of said hull conversion assembly, having one proximal end pivotally attached to a deck face of a first plate, and one distal end slidably and pivotally attached to a second plate.

18. The method of claim 17, wherein said kinematic chain assemblage includes a series of linkages and mechanisms operable to cooperate with said linear actuators to expand said water diverting plates on a predetermined path from said stowed position to said deployed position.

* * * * *